US012522412B2

(12) United States Patent
Czarnecki, Jr. et al.

(10) Patent No.: US 12,522,412 B2
(45) Date of Patent: Jan. 13, 2026

(54) CONTAINER CARRIER

(71) Applicant: ILLINOIS TOOL WORKS INC., Glenview, IL (US)

(72) Inventors: Michael P. Czarnecki, Jr., Bensenville, IL (US); Christopher J. Samaras, Tinley Park, IL (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 18/666,303

(22) Filed: May 16, 2024

(65) Prior Publication Data

US 2024/0351761 A1 Oct. 24, 2024

Related U.S. Application Data

(63) Continuation-in-part of application No. 18/639,553, filed on Apr. 18, 2024.

(60) Provisional application No. 63/467,194, filed on May 17, 2023, provisional application No. 63/460,466, filed on Apr. 19, 2023.

(51) Int. Cl.

| | |
|---|---|
| ***B65D 71/50*** | (2006.01) |
| ***B65D 63/10*** | (2006.01) |
| ***B65D 63/18*** | (2006.01) |

(52) U.S. Cl.

CPC ..... *B65D 63/18* (2013.01); *B65D 63/10* (2013.01); *B65D 71/504* (2013.01)

(58) Field of Classification Search

CPC ..... B65D 71/42; B65D 71/40; B65D 71/50; B65D 71/44; B65D 71/504; B65D 63/10; B65D 63/18

USPC ..... 206/151, 158, 427

See application file for complete search history.

(56) References Cited

U.S. PATENT DOCUMENTS

| | | | | |
|---|---|---|---|---|
| 3,426,501 A | | 2/1969 | Earp | |
| 3,509,684 A | | 5/1970 | Hohl et al. | |
| 4,093,295 A | * | 6/1978 | Erickson | B65D 71/50 206/199 |
| 4,324,085 A | | 4/1982 | Olsen | |

(Continued)

FOREIGN PATENT DOCUMENTS

| | | |
|---|---|---|
| CN | 2466080 Y | 12/2001 |
| DE | 102020126782 B3 | 2/2022 |
| EP | 4119465 A1 | 1/2023 |

OTHER PUBLICATIONS

PCT International Search Report, Form PCT/ISA/210, for International Application PCT/US2024/029826, Jul. 23, 2024 (5 pages).

(Continued)

*Primary Examiner* — Steven A. Reynolds

(74) *Attorney, Agent, or Firm* — Pauley Erickson & Swanson

(57) ABSTRACT

A container carrier forming a package of unitized containers includes a network of molded ribs forming a plurality of container receiving openings formed in a plane. An arrangement of inwardly extending tabs are formed in each container receiving opening toward a center of each container receiving opening. A plurality of discrete handles are formed along one edge of the container carrier. The container carrier is engageable with a sidewall of each container so that each tab of the arrangement of tabs engages with a corresponding container of the plurality of containers.

12 Claims, 5 Drawing Sheets

(56) References Cited

U.S. PATENT DOCUMENTS

| | | | | |
|---|---|---|---|---|
| 5,117,609 | A | 6/1992 | Seymour et al. | |
| 5,383,321 | A | 1/1995 | Krogman et al. | |
| 5,535,879 | A * | 7/1996 | Appleton | B65D 71/504 294/87.2 |
| 6,122,893 | A | 9/2000 | Weaver et al. | |
| 6,170,225 | B1 | 1/2001 | Cervantes et al. | |
| 6,588,173 | B1 | 7/2003 | Moore et al. | |
| 7,637,077 | B2 | 12/2009 | Slovik et al. | |
| 8,387,341 | B2 | 3/2013 | Moore et al. | |
| 11,124,341 | B2 * | 9/2021 | Patton | B65D 71/504 |
| 11,401,095 | B2 * | 8/2022 | Rosenbrien | B65D 71/44 |
| 11,420,802 | B2 * | 8/2022 | Kooc | B65D 71/504 |
| 2007/0261373 | A1 | 11/2007 | Slovik et al. | |
| 2012/0241332 | A1 * | 9/2012 | Crossman | A45F 5/00 206/158 |
| 2014/0300026 | A1 * | 10/2014 | Taccolini | D21H 19/822 264/129 |
| 2018/0346216 | A1 * | 12/2018 | Borg | B65D 71/20 |
| 2020/0010255 | A1 * | 1/2020 | Zacherle | B65D 71/44 |
| 2022/0258943 | A1 * | 8/2022 | Walling | B65D 71/40 |
| 2024/0351765 | A1 * | 10/2024 | Barreto | B65D 71/504 |

OTHER PUBLICATIONS

PCT Written Opinion of the International Searching Authority, Form PCT/ISA/237, for International Application PCT/US2024/029826, Jul. 23, 2024 (7 pages).

* cited by examiner

CONTAINER CARRIER

CROSS REFERENCE TO RELATED APPLICATION

This application claims the benefit of U.S. Provisional Application, Ser. No. 63/467,194, filed on 17 May 2023; and this application is a continuation-in-part of U.S. patent application Ser. No. 18/639,553, filed on 18 Apr. 2024, which claims the benefit of U.S. Provisional Application, Ser. No. 63/460,466, filed on 19 Apr. 2023.

The above-referenced U.S. Provisional Patent Applications and co-pending U.S. Patent Application are hereby incorporated by reference herein in their entirety and is made a part hereof, including but not limited to those portions which specifically appear hereinafter.

BACKGROUND OF THE INVENTION

Field of the Invention

This invention relates generally to beverage multipacks and, more particularly, to multipacks made up of a plurality of containers.

Description of Prior Art

Conventional container carriers are often used to unitize a plurality of similarly sized containers, such as cans, bottles, jars and boxes and/or similar containers that require unitization. Flexible plastic ring carriers and paperboard boxes are two such conventional container carriers.

However, with growing concerns surrounding the environmental impact of improper disposal of plastic waste, manufacturers are transitioning offerings to best support a circular economy. One such solution is plastic ring carriers made from 50% post-consumer recycled content. This carrier is operationally efficient, competitively priced, simple, and has a low carbon footprint in comparison to other beverage multipack alternatives. Today, this flexible solution is not considered 100% curbside recyclable by the FTC Green Guide because 60%+ consumers cannot recycle flexible plastics.

Multi-packaging systems are generally used in the beer, soft drink, and general products industries. A new and innovative beverage multipackaging solution is desirable that includes a 4, 6, 8, and/or 12 beverage capacity. A preferred design is produced using 100% curbside recyclable rigid plastics, like HDPE, PPE, or PET. These carriers would be applied on PET bottles and/or aluminum cans.

SUMMARY OF THE INVENTION

The invention generally relates to a container carrier for unitizing a plurality of containers into a multipack.

A preferred embodiment of the subject invention is made from materials that are 100% curbside recyclable, in particular rigid PET, PPE, and HDPE plastics that can enter most municipal recycling streams. Although such polymers are preferred, other materials may be utilized including non-conventional polymers and non-polymers that exhibit characteristics beneficial to this application while also maintaining recyclability. This invention focuses on end-user needs and structural plastics that can easily be recycled. A solution that is meaningful, practical and makes a positive impact to encourage people to recycle is desired.

Moreover, the subject invention may leverage contours and/or features of the containers to ensure a reliable and sturdy package. According to one preferred embodiment, container engaging apertures and/or features of such apertures are engageable within the contours and/or features of the respective containers.

In addition, it is desirable to manufacture a container carrier that is flexible in final package configuration. As such, a container carrier that may be divided from a "mother" carrier into multiple sellable packages is desired.

Other objects and advantages will be apparent to those skilled in the art from the following detailed description taken in conjunction with the appended claims and drawings.

DETAILED DESCRIPTION OF THE INVENTION

Figure 1:
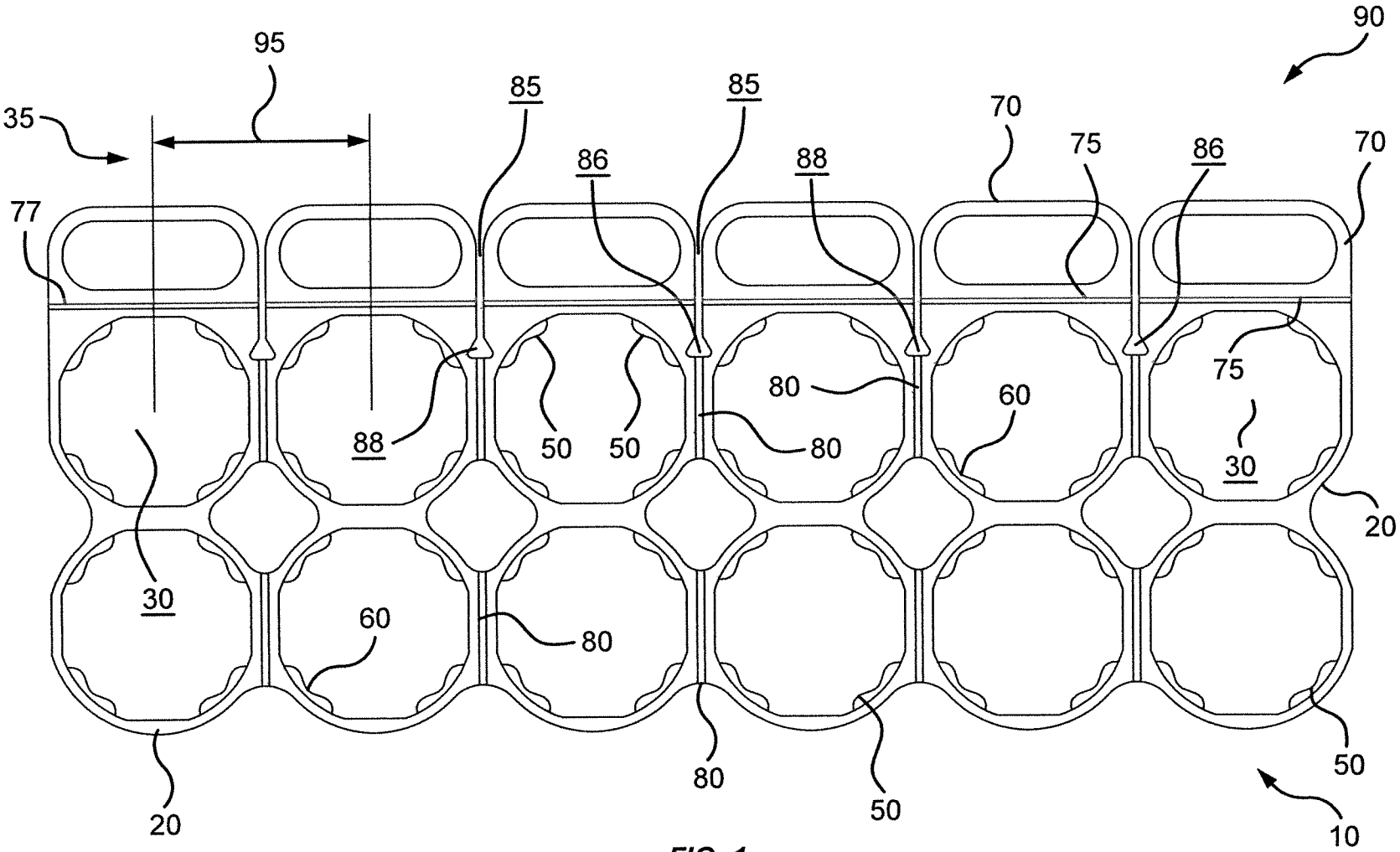
FIG. 1 shows a top plan view of a stick of container carriers according to one embodiment.
Figure 2:
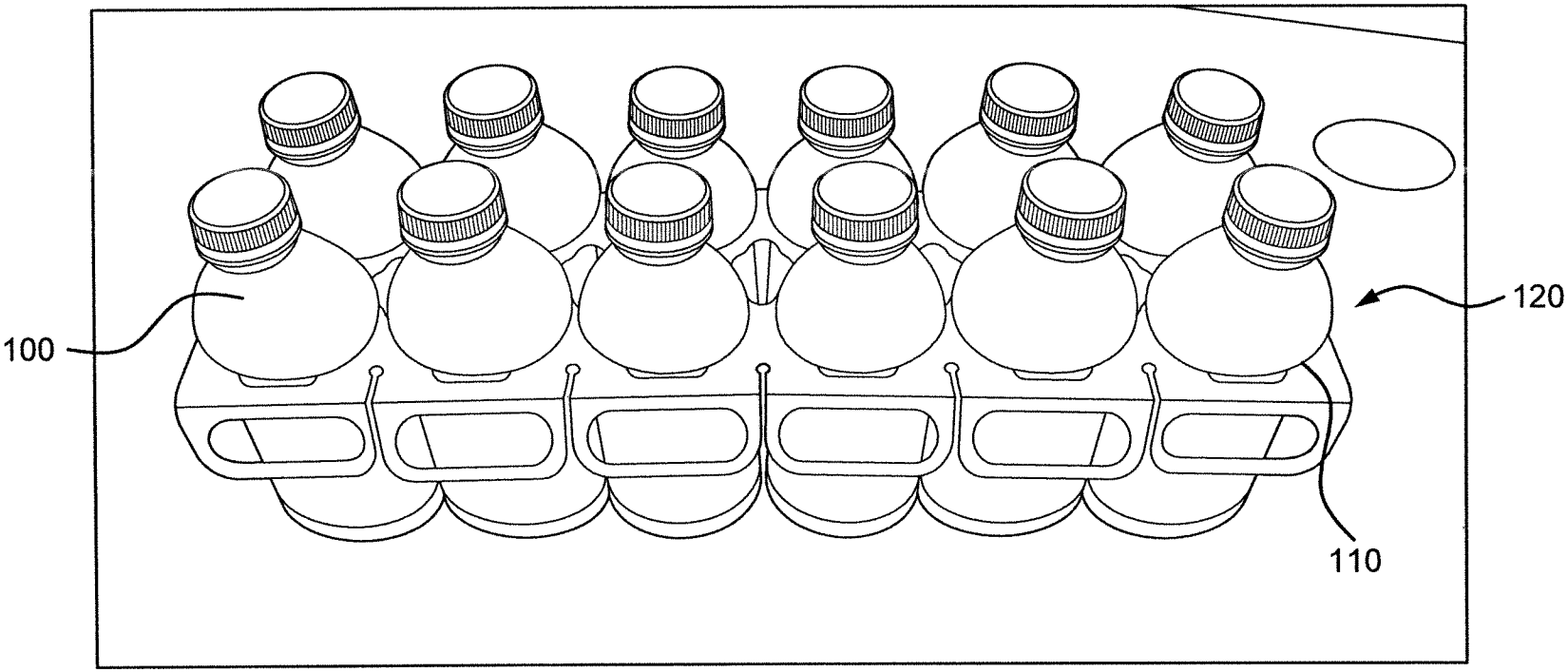
FIG. 2 shows a top perspective view of a package of containers according to one embodiment.
Figure 3:
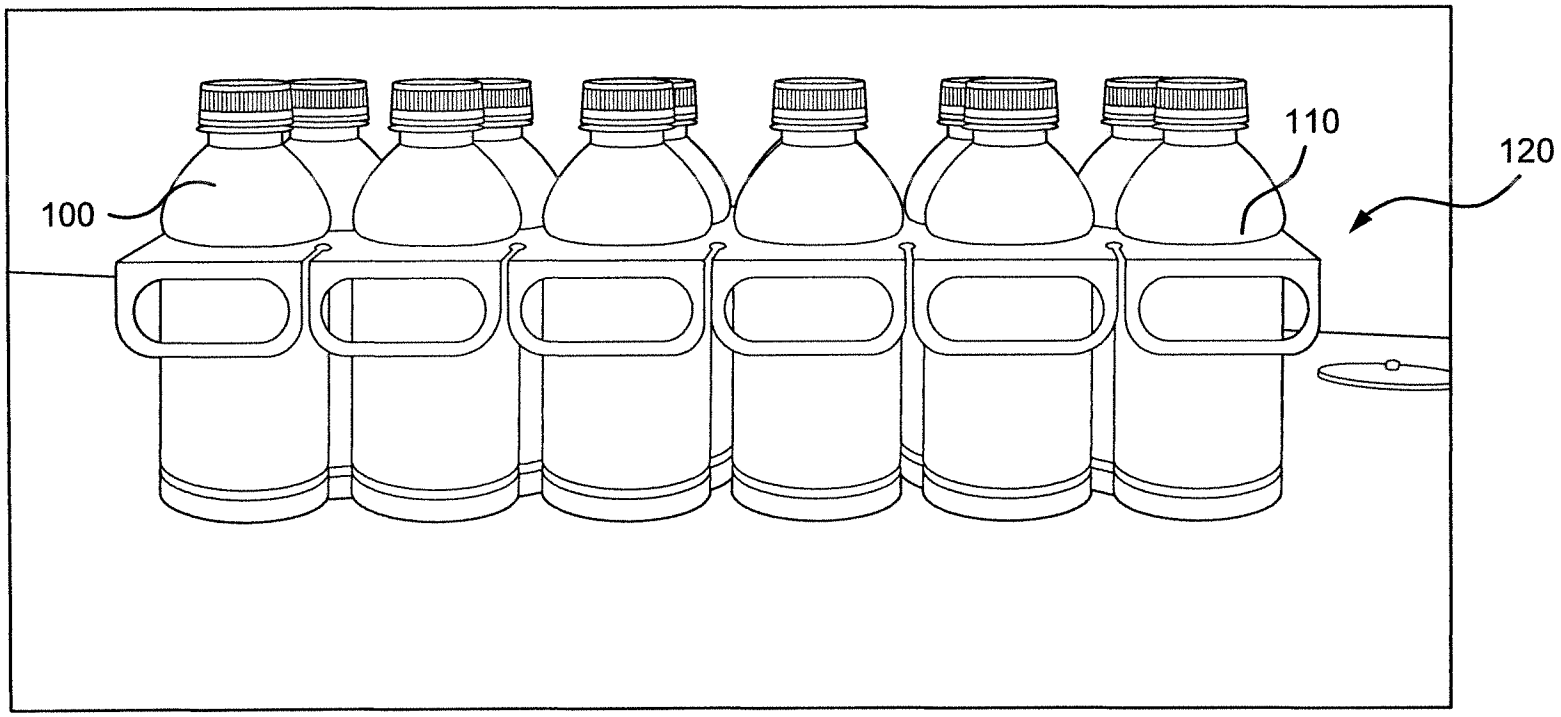
FIG. 3 shows a side view of the package shown in FIG. 2.

The present invention provides a container carrier to unitize a plurality of containers into beverage multipacks. Container carriers and various unitized packages of containers according to various embodiments of this invention is shown in FIGS. 1-5.

According to a preferred embodiment of this invention, the container carrier 10 is injection molded or otherwise formed from high density polyethylene (HDPE). Alternatively, PET or PPE plastics may be used. Alternatively, other polymers may be used or even non-polymers that exhibit desired characteristics for this application. Preferably, the material is generally rigid and 100% post-consumer recyclable in most or all markets.

Once manufactured, the container carrier 10 may be applied to groups of containers 100 to make completed unitized multipacks or packages 120. It is contemplated and desirable that a single stick of container carries 10 is capable of division into 2 packs, 4 packs, 6 packs, 8 packs, 10 packs and/or 12 packs without departing from the essential features of this invention.

In a preferred embodiment of this invention, the container carrier 10 includes a network of molded ribs 20 forming a plurality of container receiving openings 30 corresponding with a desired size of multipack. As shown in the figures, the container receiving openings 30 are preferably arranged in transverse pairs. FIG. 1 shows a 2×6 array stick for a twelve pack that may be further broken down into one or more transverse pairs forming packages of 2, 4, 6, 8, and/or 10 containers depending on a desired quantity multipack size.

The plurality of container receiving openings 30 are preferably formed in a plane 35. As used herein, the plane 35 generally includes at least one side of the container carrier that is entirely planar. Although the container carrier 10 described includes some thickness, the thickness is generally negligible compared to a footprint of the container carrier 10, particularly in the embodiments shown in FIG. 1.

Figure 4:
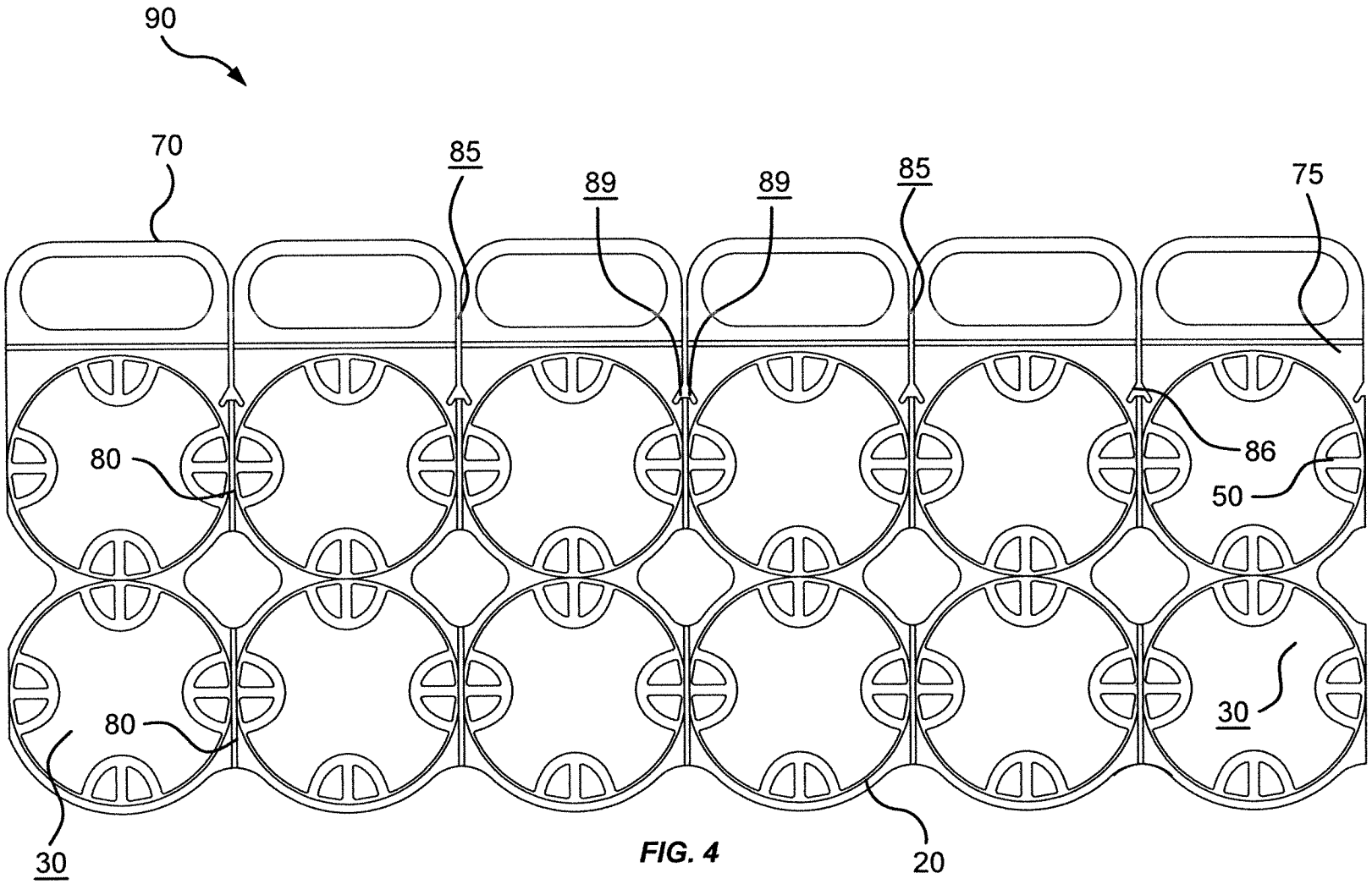
FIG. 4 shows a top plan view of a stick of container carriers according to one embodiment.
Figure 5:
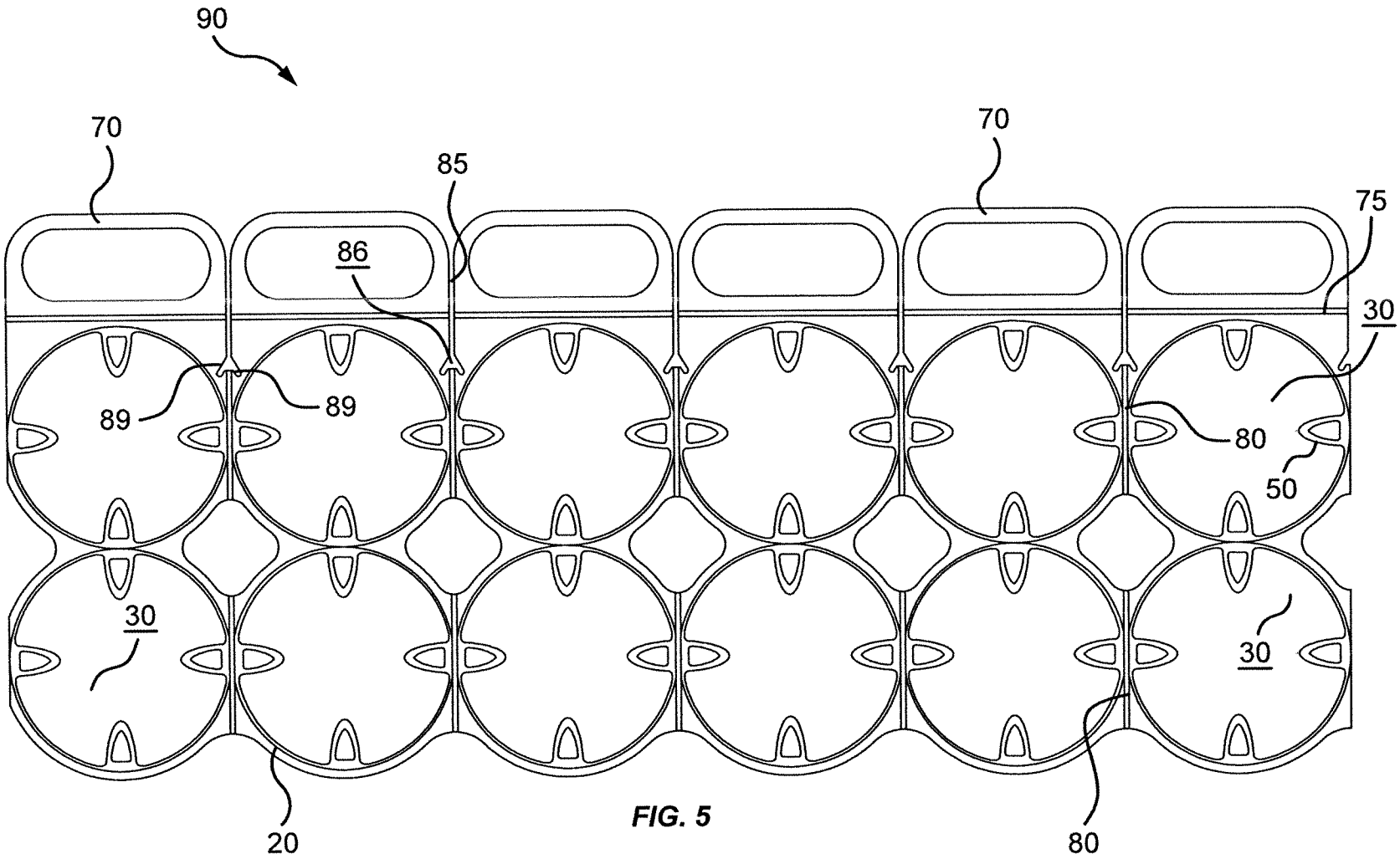
FIG. 5 shows a top plan view of a stick of container carriers according to one embodiment.

The plurality of container receiving openings 30 are preferably of a common size and configuration across the container carrier 10. FIG. 1 shows one embodiment of container receiving openings 30 that, though generally circular, include four flat sections around a perimeter of the container receiving opening 30. FIGS. 4 and 5 show an alternative embodiment of the container receiving openings 30 that are purely circular.

As shown for example in FIG. 1, a stick 90 of adjacent container carriers 10 for unitizing a plurality of containers include a network of molded ribs 20 forming a plurality, in this case twelve, container receiving openings 30. A series of frangible connection points or joints 80 are preferably formed between each transverse pair of container receiving openings. As such, each stick 90 may or may not include frangible connection points 80 between adjacent transverse pairs of container carriers 10. The frangible connection points 80 are preferably formed between each transverse pair of container receiving openings 30 and thus enable dividing the container carrier 10 into multiple sub-packages, each for unitizing a desired set of containers. This configuration enables a single manufacturing tool to generate a universal pack size carrier that can be processed via an applicating machine into any desired pack sizes through a change in operating program and/or mechanical parts.

An arrangement of inwardly extending tabs 50 are formed in each container receiving opening 30 toward a center of each container receiving opening 30. Each tab 50 of the arrangement of tabs 50 are engageable with a corresponding container 100, such as within a circumferential groove 110 in a corresponding container 100 of the plurality of containers 100 to form a package. The arrangement preferably comprises a plurality of inwardly extending tabs 50 formed in each container receiving opening 30 toward a center of each container receiving opening 30. Each tab 50 of the arrangement of tabs 50 in each container receiving opening 30 engageable with a corresponding container 100 of the plurality of containers 100.

FIG. 1 shows one arrangement of tabs 50 which preferably comprises a central depression 60 and the arrangement of tabs 50 are preferably positioned equidistantly around an inner edge of each opening 30 of the plurality of container receiving openings 30. According to the embodiment shown in FIG. 1, the tabs 50 are 45 degrees offset from a longitudinal direction of the respective carrier 10.

FIGS. 4 and 5 show two other arrangement of tabs 50 that are positioned around each container receiving opening 30 at 0, 90, 180, and 270 degrees relative to the longitudinal direction of the respective carrier. FIG. 4 shows tabs 50 forming a semicircular arc extending toward the center of each respective opening 30 with a central rib bisecting the arc. FIG. 5 shows an arrangement of tabs 50 having a partial oval configuration terminating toward a center of the respective opening 30. It is noted that the opening 30 shape shown in FIG. 1 may be used in connection with the tab arrangements shown in FIGS. 4 and 5 and vice-versa.

In one embodiment, the subject tabs 50 taper in thickness as the tab structure extends toward a central portion of the container receiving openings 30. As such, the tab 50 may be thickest where attached to the opening edge and thinnest at a distal end toward a center of the opening.

A plurality of discrete handles 70 are preferably formed along one edge of the container carrier 10. As shown in FIG. 1, a handle 70 is formed adjacent to each transverse pair of container receiving openings 30 along one longitudinal edge of the carrier 10. In this way, six handles 70 are formed along container carrier 10 shown in FIGS. 1, 4, and 5. Depending on the size of the resulting package, one or more handles 70 may be grasped by the consumer to form a comfortable, compact, tightly unitized plurality of containers 100 within the package 120. The plurality of discrete handles 70 formed along one edge of the container carrier 10 thereby correspond with respective transverse pairs of container receiving openings 30.

According to a preferred embodiment, the container carrier 10 includes a longitudinal space 85 between each handle 70 of the plurality of discrete handles 70. The longitudinal space 85 preferably terminates in an opening 86 between adjacent container receiving openings 30. The subject opening 86 enable separation of the frangible joints 80 between transverse pairs of container openings 30 to be separated without damaging the integrity of the resulting package(s). The opening 86 may be triangular 88 such as shown in FIG. 1. Alternatively, the opening 86 may comprise two prongs 89, wherein each prong 89 extends toward a closest respective container receiving opening 30.

In a preferred embodiment, each tab 50 comprises a thickness less than a thickness of the network of molded ribs 20 forming the plurality of container receiving openings 30. By reducing a thickness of the tabs 50, the containers 100 may be applied and, particularly, removed with less effort than tabs 50 having a full thickness. This assists the consumer in removing containers 100 from the package 120 without undue force.

In a preferred embodiment, a line of weakness creating a hinge 75 is formed between each handle 70 and the longitudinal edge of the container carrier 10. The hinge 75 may be formed with a reduced thickness of material between the one edge of the container carrier 10 and the handle 70. More specifically, the hinge 75 may comprise a fillet 77, specifically a semi-circular or triangular groove, extending across the one edge of the container carrier 10. According to one embodiment, the reduced thickness or fillet 77 is positioned along an underside of the container carrier 10. In such an arrangement, the handle 70 may be urged downward after application to permit a more compact package 120 without undue interference from an outwardly extending handle 70.

The subject design may accommodate high speed application for high application efficiency that can be used in standard bottle lines—which current curbside recyclable beverage multipacks struggle to meet. Further, the side-applied attachment method allows for a uniform pack size, stability, function similar to traditional flexible multipacks without damaging bottle labels. Store merchandising is also improved through the subject design because of ease of the foldable handle design and pack integrity. The tabbed bottle retention feature further permit the container carrier to be applied to differing bottle shapes and sizes For ease of application to containers and handling of bulk container carriers 10, a pitch 95, or longitudinal distance, between adjacent container receiving openings 30 is constant throughout the stick 90. As such, the pitch 95 between container receiving openings 30 within a single container carrier 10 is the same as the pitch 95 between edge container receiving openings 30 of adjacent container carriers 10 that are joined within the stick 90.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

The invention claimed is:

1. A container carrier for unitizing a plurality of containers, the container carrier comprising:

a network of molded ribs forming a plurality of container receiving openings;

an arrangement of inwardly extending tabs formed in each container receiving opening toward a center of each container receiving opening, each tab of the arrangement of tabs engageable with a corresponding container of the plurality of containers; and a plurality of discrete handles formed along one edge of the container carrier, each handle corresponding with a transverse pair of container receiving openings, wherein the container carrier comprises a longitudinal space between each handle of the plurality of discrete handles and wherein the longitudinal space terminates in an opening between adjacent container receiving openings, wherein the opening comprises two prongs, each prong extending toward a closest respective container receiving opening.

2. The container carrier of claim 1 further comprising frangible joints formed between each transverse pair of container receiving openings.

3. The container carrier of claim 2 wherein the container carrier comprises a stick of tranverse pairs of container receiving openings that are dividable into a desired even number of containers smaller than the stick.

4. The container carrier of claim 1 wherein each tab is engageable with a circumferential groove in the corresponding container.

5. The container carrier of claim 1 comprising a reduced thickness between each transverse pair of container receiving openings.

6. The container carrier of claim 1 wherein the container carrier comprises twelve six pairs of transverse container receiving openings.

7. The container carrier of claim 1 comprising a line of weakness positioned between each handle and each respective transverse pair of container receiving openings.

8. The container carrier of claim 7 wherein the line of weakness comprises a reduced thickness of material.

9. The container carrier of claim 1 wherein each arrangement of inwardly extending tabs comprise a lesser thickness than the network of molded ribs.

10. A container carrier for unitizing a plurality of containers, the container carrier comprising:

a network of molded ribs forming a plurality of container receiving openings arranged in transverse pairs;

frangible joints formed between each transverse pair of container receiving openings;

an arrangement of inwardly extending tabs formed in each container receiving opening toward a center of each container receiving opening, each tab of the arrangement of tabs engageable with a corresponding container of the plurality of containers; and a plurality of discrete handles formed along one edge of the container carrier, each handle corresponding with each transverse pair of container receiving openings, wherein a longitudinal space is formed between each handle of the plurality of discrete handles, the longitudinal space terminating in an opening wider than the longitudinal space between adjacent container receiving openings, wherein the opening comprises two prongs, each prong extending toward a closest respective container receiving opening.

11. The container carrier of claim 10 wherein the container carrier comprises a stick of tranverse pairs of container receiving openings that are dividable into a desired even number of containers smaller than the stick.

12. The container carrier of claim 10 wherein the tab includes a tapered thickness from a thickest portion at a proximal end along the opening to a thinnest portion at a distal end at a furthest edge.

* * * * *